US008037876B1

(12) United States Patent
Yehle

(10) Patent No.: US 8,037,876 B1
(45) Date of Patent: Oct. 18, 2011

(54) PULLEY-AND-CABLE POWER CABLE TENSIONING MECHANISM FOR A COMPOUND ARCHERY BOW

(75) Inventor: Craig T. Yehle, Junction City, OR (US)

(73) Assignee: Extreme Technologies, Inc., Eugene, OR (US)

( * ) Notice: Subject to any disclaimer, the term of this patent is extended or adjusted under 35 U.S.C. 154(b) by 225 days.

(21) Appl. No.: 12/511,085

(22) Filed: Jul. 29, 2009

(51) Int. Cl.
*F41B 5/10* (2006.01)

(52) U.S. Cl. ..... 124/25.6

(58) Field of Classification Search ..... 124/25.6, 124/900

See application file for complete search history.

(56) References Cited

U.S. PATENT DOCUMENTS 4,461,267 A * 7/1984 Simonds et al. ..... 124/25.6
6,076,512 A * 6/2000 Thielen et al. ..... 124/25.6
6,776,148 B1 * 8/2004 Islas ..... 124/25.6
6,792,931 B1 * 9/2004 Schaar ..... 124/25.6
7,047,958 B1 * 5/2006 Colley ..... 124/25.6

* cited by examiner

*Primary Examiner* — John Ricci
(74) *Attorney, Agent, or Firm* — David S. Alavi

(57) ABSTRACT

A bow comprises: a riser; first and second limbs attached to the riser; first and second pulley members rotatably connected to the respective bow limbs; draw, power, and tensioning cables; and a tensioning pulley. The draw cable engages draw cable journals of the pulley members and rotates them as the bow is drawn and the draw cable is let out from the draw cable journals. The tensioning cable is secured at its first end to the first bow limb and engaged at its second end to be taken up by a power cam of the first pulley member as the bow is drawn and the first pulley member rotates. The tensioning pulley includes a tensioning cable journal and is arranged with the tensioning cable engaged therewith. The power cable is connected at its first end to the tensioning pulley and at its second end to the second bow limb.

19 Claims, 14 Drawing Sheets

PULLEY-AND-CABLE POWER CABLE TENSIONING MECHANISM FOR A COMPOUND ARCHERY BOW

BACKGROUND

The field of the present invention relates to compound archery bows. In particular, compound archery bows are disclosed herein that include a pulley-and-cable mechanism for applying tension to a power cable of the bow.

For purposes of the present disclosure and appended claims, the terms "compound archery bow" or "compound bow" shall denote an archery bow that uses a levering system, usually comprising one or more cables and pulleys, to bend the limbs as the bow is drawn. A wide variety of compound archery bows include one or two power cables. Conventionally, each power cable is connected at one end to one bow limb and is engaged at its other end to be taken up by a power cam of a pulley member rotatably mounted on the other bow limb. Tension developed as the bow is drawn and the power cable is taken up by the power cam causes deformation of the bow limbs and storage of potential energy therein. A portion of that potential energy is transformed into the kinetic energy of the arrow shot by the bow. Examples of compound bows include dual-cam bows, bows that employ a Binary Cam System®, hybrid-cam bows, or single-cam bows. A few examples of these various compound bow types are disclosed in the following patents, all of which are incorporated by reference as if fully set forth herein:

U.S. Pat. No. 4,686,955 entitled "Compound archery bows" issued Aug. 18, 1987 to Larson, disclosing an example of a dual-cam compound bow;

U.S. Pat. No. 7,305,979 entitled "Dual-cam archery bow with simultaneous power cable take-up and let-out" issued Dec. 11, 2007 to Yehle, disclosing an example of a compound bow that employs a Binary Cam System®;

U.S. Pat. No. 6,871,643 entitled "Eccentric elements for a compound archery bow" issued Mar. 29, 2005 to Cooper et al, disclosing an example of a hybrid-cam compound bow; and U.S. Pat. No. 5,368,006 entitled "Dual-feed single-cam compound bow" issued Nov. 29, 1994 to McPherson, disclosing an example of a single-cam compound bow.

An example of a conventional dual-cam compound bow 10 is illustrated in FIGS. 1 and 2A-2B. FIG. 1 shows the entire bow in an undrawn state (i.e., at brace), and FIGS. 2A and 2B show details of the pulley members and cables at brace and at full draw, respectively. The bow 10 comprises a substantially rigid riser 15, first and second resilient bow limbs 11 and 12, respectively, first and second pulley members 20 and 30, respectively, draw cable 16, and first and second power cables 22 and 32, respectively. The first and second bow limbs 11 and 12 are attached to corresponding first and second end portions of the riser 15. The first pulley member 20 is rotatably connected to the first bow limb 11 at a corresponding pulley connection point and includes a draw cable journal (on the periphery of a draw cable cam 24) and a first power cam 26. The second pulley member 30 is rotatably connected to the second bow limb 12 at a corresponding pulley connection point and includes a draw cable journal (on the periphery of a draw cable cam 34) and a second power cam 36. The draw cable 16 is engaged with the respective draw cable journals of the draw cable cams 24 and 34. The draw cable 16 is arranged to rotate the first and second pulley members 20 and 30 as the bow 10 is drawn and the draw cable 16 is let out from the draw cable journals of cams 24 and 34. The first power cable 22 is engaged at its first end to be taken up by the first power cam 26 as the bow 10 is drawn and the first pulley member 20 rotates (FIG. 2B), and is connected at its second end to the second bow limb 12. The second power cable 32 engaged at its first end to be taken up by the second power cam 36 as the bow 10 is drawn and the second pulley member 30 rotates, and is connected at its second end to the first bow limb 11.

When bow 10 is drawn, the power cams 26 and 36 take up the respective power cables 22 and 32. The resulting tensioning of the power cables 26 and 36 deforms the bow limbs 11 and 12, thereby storing potential energy in the limbs. When the drawn bow is released to shoot an arrow, a portion of the stored potential energy is converted to kinetic energy of the arrow. The relative sizes, shapes, positions, or orientations of the draw cable cams 24/34 and the power cable cams 26/36 can be arranged in any suitable way to provide desired draw force characteristics of the dual-cam bow 10. The relative sizes, shapes, positions, and orientations shown in FIGS. 1 and 2A-2B are exemplary only.

SUMMARY

A compound archery bow comprises an substantially rigid riser, first and second resilient bow limbs, first and second pulley members, a draw cable, a tensioning cable, a tensioning pulley, and a power cable. The first and second bow limbs are attached to corresponding first and second end portions of the riser, and each has a corresponding pulley connection point. The first pulley member is rotatably connected to the first bow limb at the corresponding pulley connection point and includes a draw cable journal and a power cam. The second pulley member is rotatably connected to the second bow limb at the corresponding pulley connection point and includes a draw cable journal. The draw cable is engaged with the respective draw cable journals of the first and second pulley members and is arranged to rotate the first and second pulley members as the bow is drawn and the draw cable is let out from the draw cable journals. The tensioning cable is secured at a first end thereof to the first bow limb and engaged at a second end thereof to be taken up by the power cam as the bow is drawn and the first pulley member rotates. The tensioning pulley includes a corresponding tensioning cable journal and is arranged with the tensioning cable engaged with the corresponding tensioning cable journal. The power cable is connected at a first end thereof to the tensioning pulley and is connected at a second end thereof to the second bow limb.

A method for assembling the compound archery bow comprises rotatably connecting the first pulley member to the first bow limb, rotatably connecting the second pulley member to the second bow limb, engaging the draw cable with the first and second pulley members, securing the tensioning cable to the first bow limb and engaging it with the first pulley member, connecting the power cable to the tensioning pulley and to the second bow limb, and engaging the tensioning cable with the tensioning pulley.

Objects and advantages pertaining to compound archery bows may become apparent upon referring to the exemplary embodiments illustrated in the drawings and disclosed in the following written description or appended claims.

The embodiments shown in the Figures are exemplary, and should not be construed as limiting the scope of the present disclosure or appended claims.

DETAILED DESCRIPTION OF EMBODIMENTS

Figure 1:
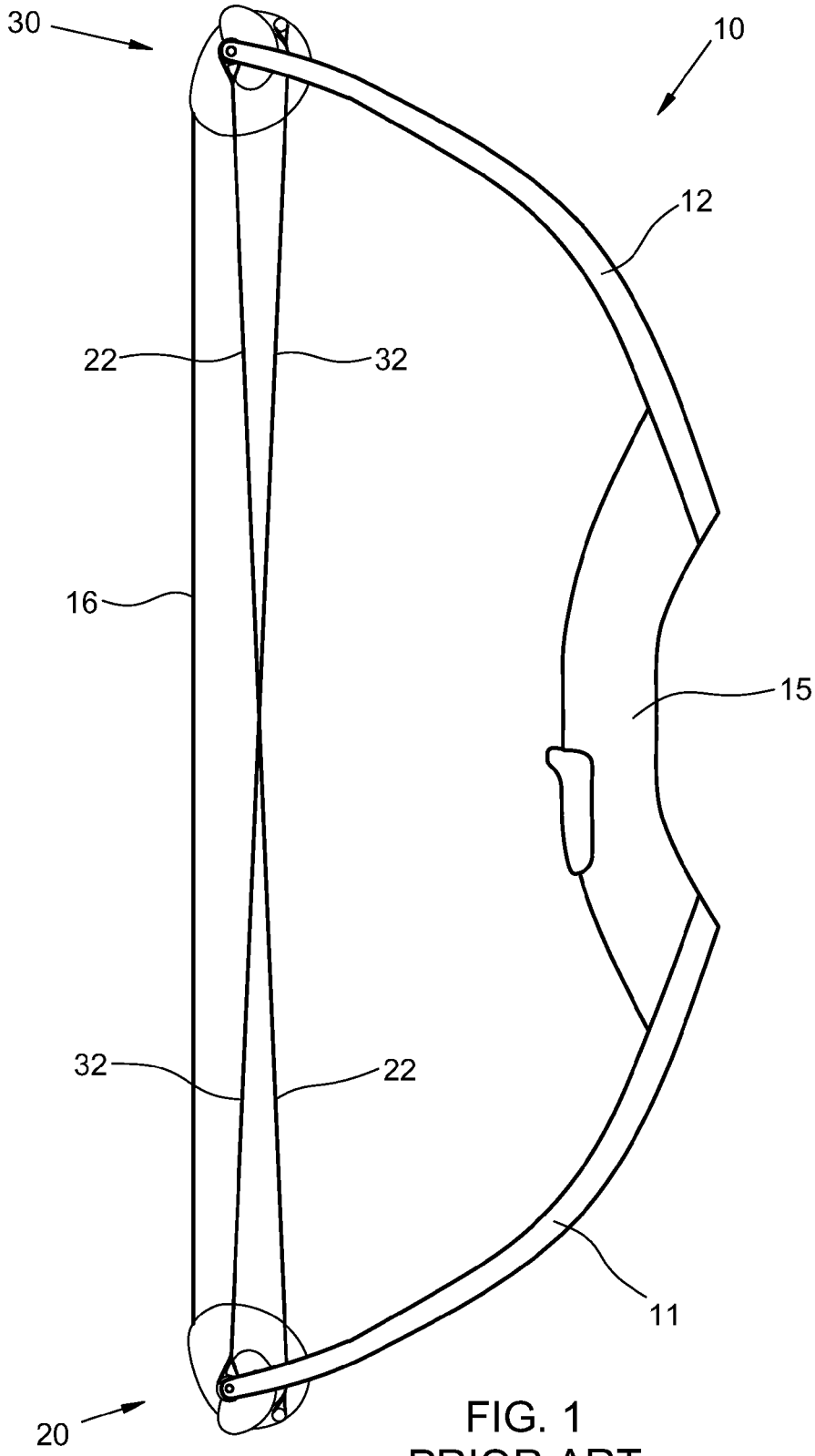
FIG. 1 PRIOR ART
FIG. 1 is a side view of a conventional dual-cam compound bow.
Figures 2A, 2B:
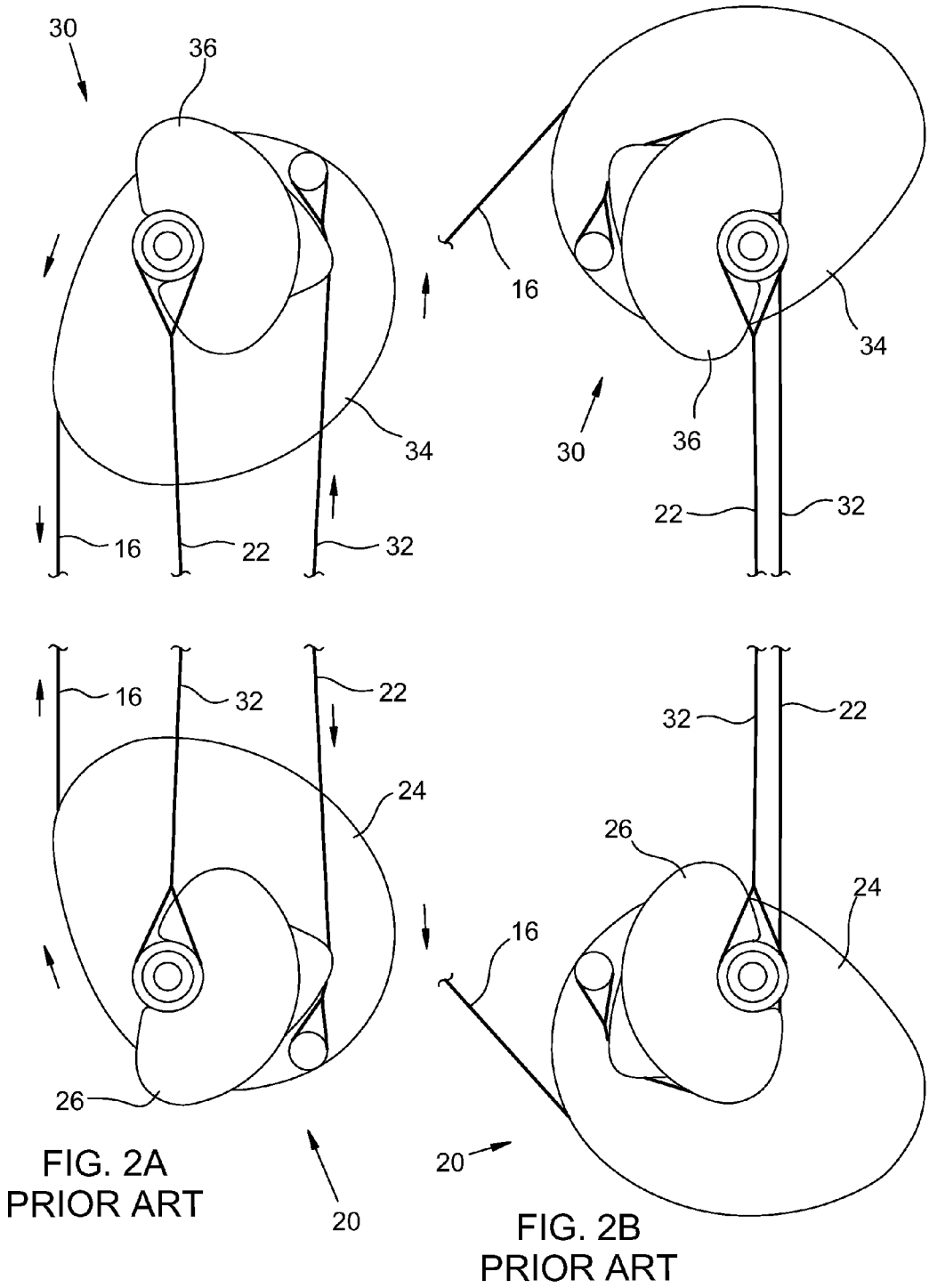
FIG. 2A PRIOR ART
FIG. 2B PRIOR ART
FIGS. 2A and 2B are side views at brace and at full draw, respectively, of pulley members and cables of a conventional dual-cam compound bow.
Figure 3A:
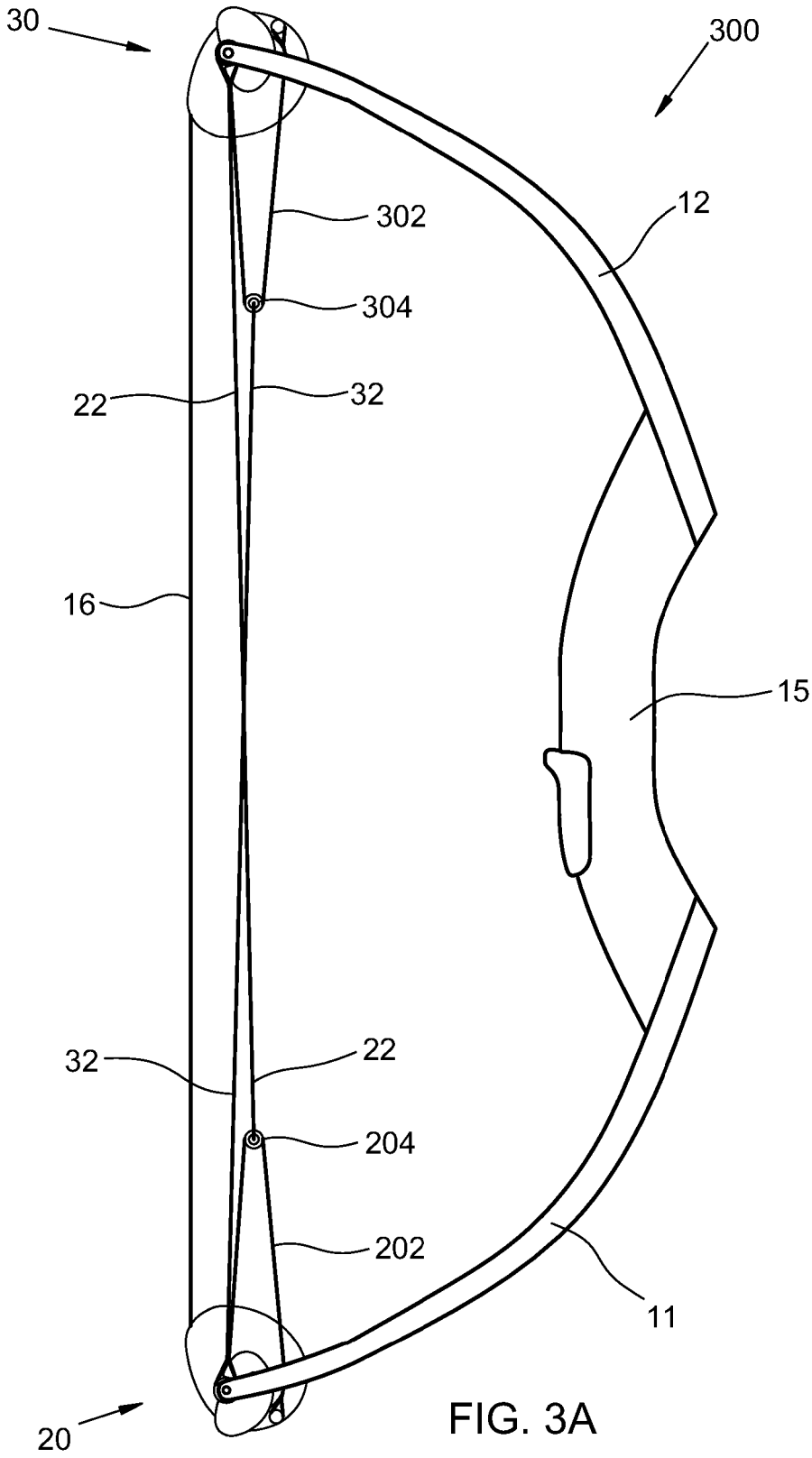
FIGS. 3A and 3B are side views at brace and at full draw, respectively, of an exemplary dual-cam compound bow according to the present disclosure.
Figure 3B:
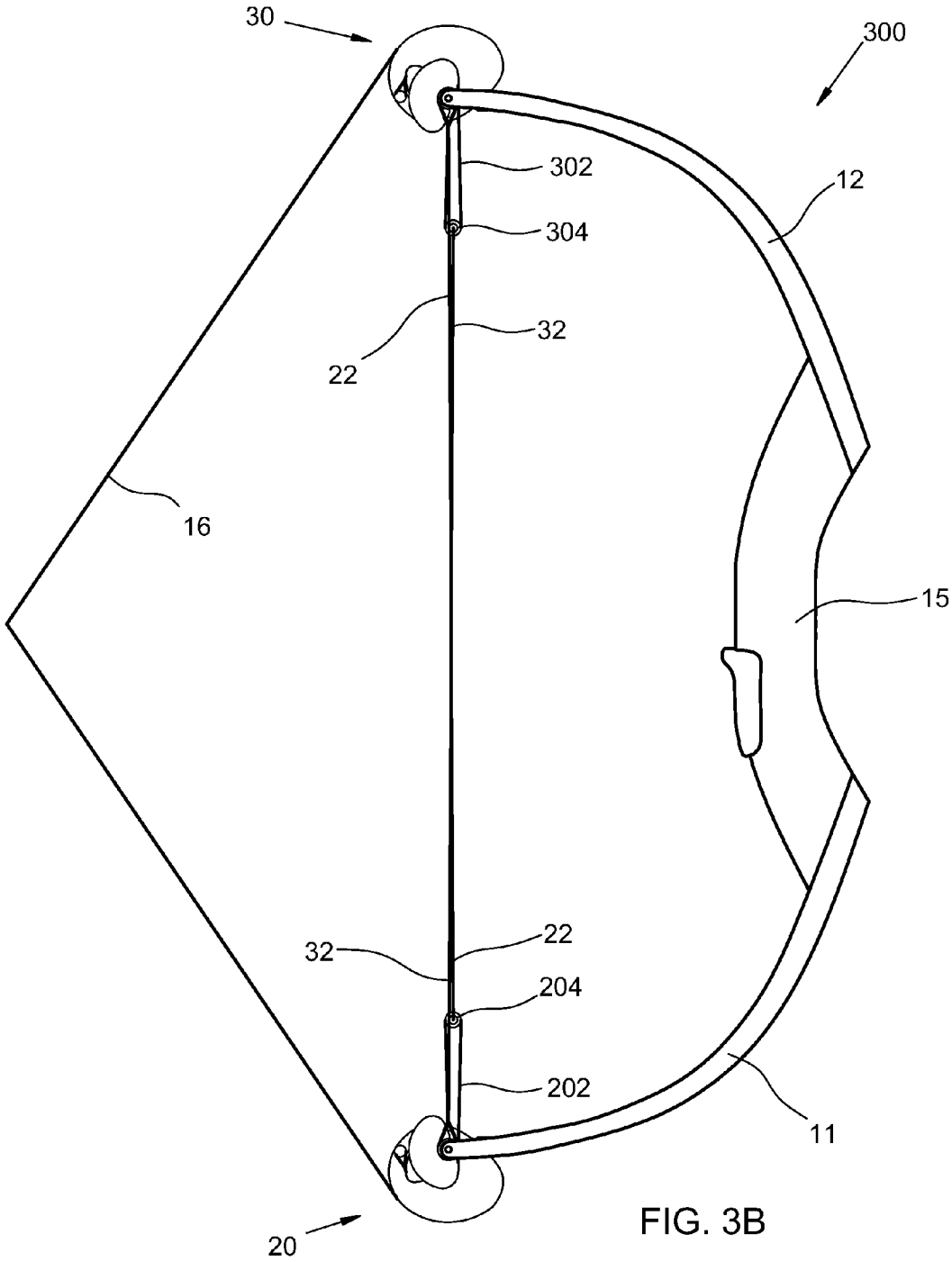
Figure 4A:
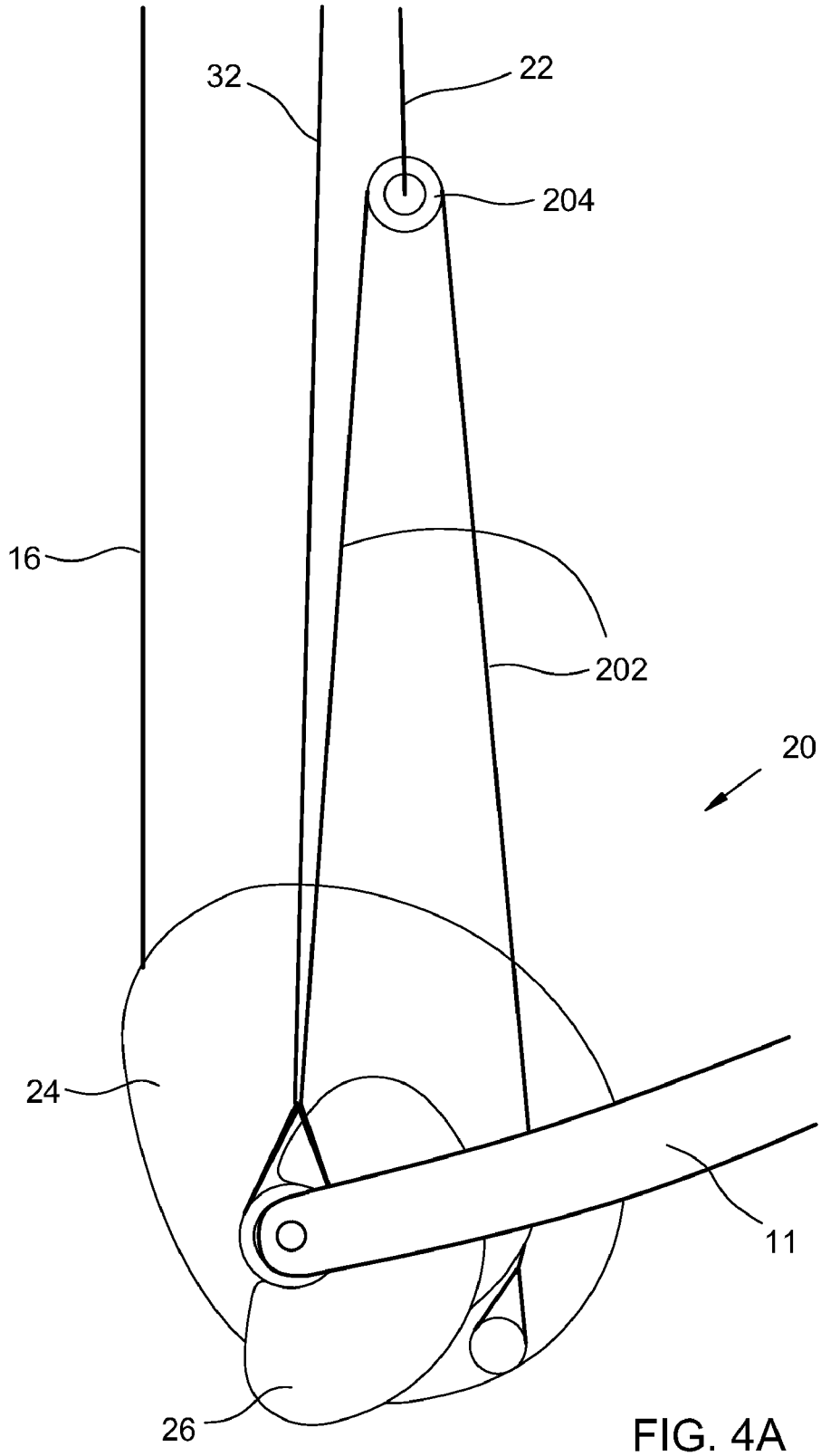
FIGS. 4A and 4B are side views at brace and at full draw, respectively, of one pulley member and one pulley-and-cable tensioning mechanism of the exemplary dual-cam compound bow of FIGS. 3A and 3B.
Figure 4B:
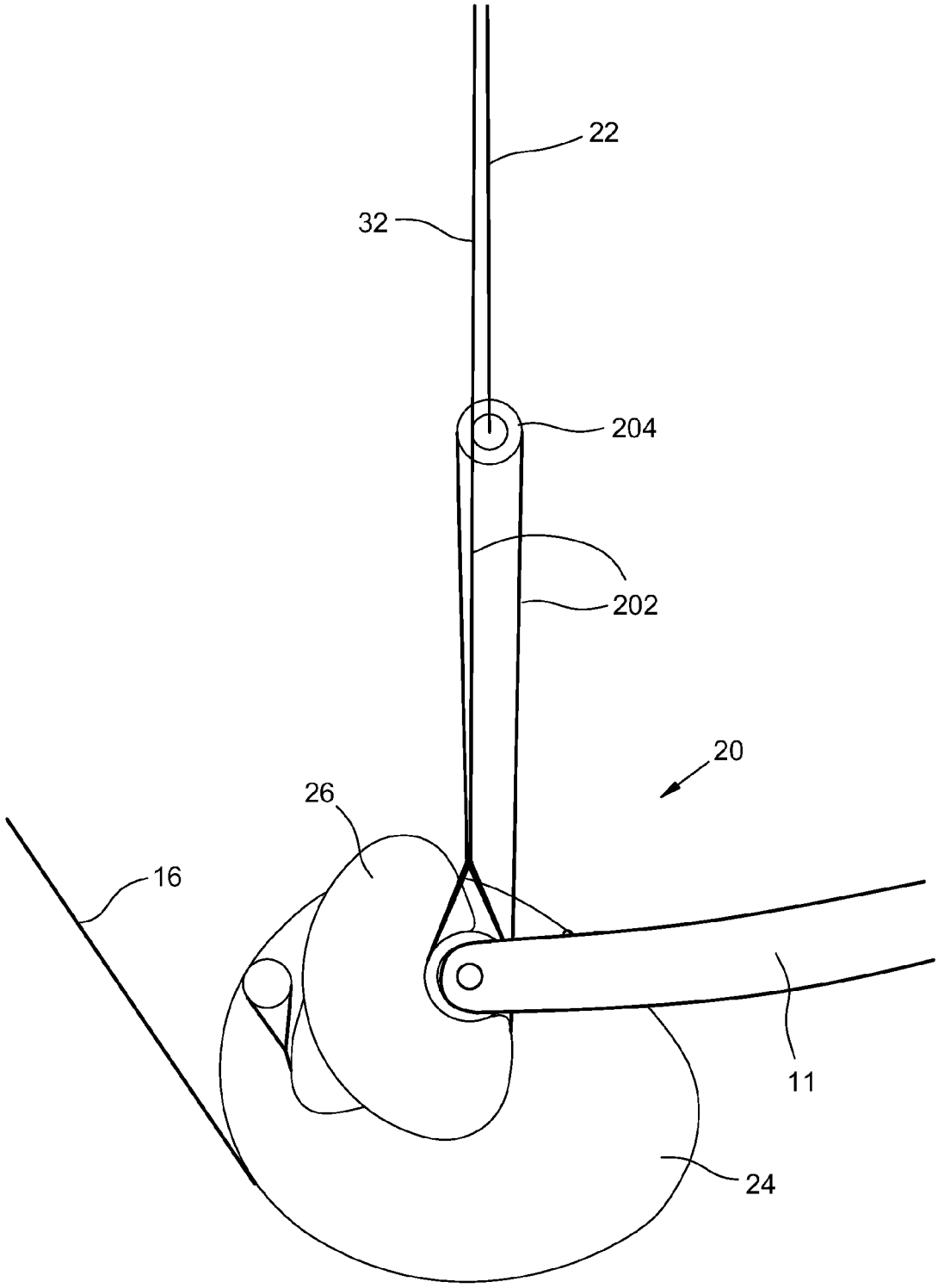

An example of a dual-cam compound bow 300 is illustrated in FIGS. 3A-3B and 4A-4B, and includes a pulley-and-cable mechanism for tensioning the power cables. FIGS. 3A and 3B show the entire bow at brace and at full draw, respectively. FIGS. 4A and 4B show details of one of the pulley members, associated cables, and a pulley-and-cable tensioning mechanism at brace and at full draw, respectively. The dual-cam compound bow 300 includes riser 15, limbs 11 and 12, pulley members 20 and 30, and draw cable 16 arranged in a manner generally similar to that of conventional dual-cam compound bow 10. The relative sizes, shapes, positions, or orientations of the draw cable cams 24/34 and the power cable cams 26/36 can be arranged in any suitable way to provide, in conjunction with the pulley-and-cable tensioning mechanism described below, desired draw force characteristics of the dual-cam bow 300. The relative sizes, shapes, positions, and orientations shown in FIGS. 3A-3B and 4A-4B are exemplary only, and those relative sizes, shapes, positions, and orientations can often differ from those shown or from those of a conventional dual-cam bow.

A pulley-and-cable tensioning mechanism for power cable 22 comprises tensioning cable 202 and tensioning pulley 204. The tensioning cable 202 is secured at its first end to bow limb 11 (in this example by looping around the axle of the pulley member 20; any suitable attachment or connection can be employed), and is engaged at its second end to be taken up by power cam 26. Tensioning pulley 204 includes a corresponding tensioning cable journal (typically arranged about its periphery), and is arranged with the tensioning cable 202 engaged with the corresponding tensioning cable journal. The first end of power cable 22 is connected to the tensioning pulley 204 in any suitable manner that allows rotation of the tensioning pulley 204. The second end of power cable 22 is connected at its second end to bow limb 12 (for example by having two split end portions each looping around the axle of pulley member 30 on opposite sides of limb 12; any suitable attachment or connection can be employed). Rotation of pulley member 20 as the bow is drawn causes movement of tensioning pulley 204 toward bow limb 11 and tension to be applied to power cable 22. A similar pulley-and-cable tensioning mechanism comprising tensioning cable 302 and tensioning pulley 304 is arranged to apply tension to power cable 32 as the bow 300 is drawn, tensioning cable 302 is taken up by power cam 36, and pulley 304 connected to the first end of power cable 32 moves toward limb 12.

The pulley-and-cable power cable tensioning mechanism provides a mechanical advantage of two for applying tension to the power cables 22 and 32. The tensioning mechanism can be employed to apply greater tension for a given arrangement of cams 24/26 and 34/36 (i.e., size, shape, position, or orientation). Such an adaptation can allow use of stiffer bow limbs, for example, that can result in reduced limb and pulley movement, reduced noise, or reduced vibration when the bow is shot. Alternatively, the tensioning mechanism can be employed to enable the use of a relatively larger power cam lever arm for a given desired applied tension. Such an adaptation can allow the bow to exhibit larger let-off of the draw force, for example, because the ratio of power cam lever arm reduction at let-off can be larger for a larger power cam.

Figure 8:
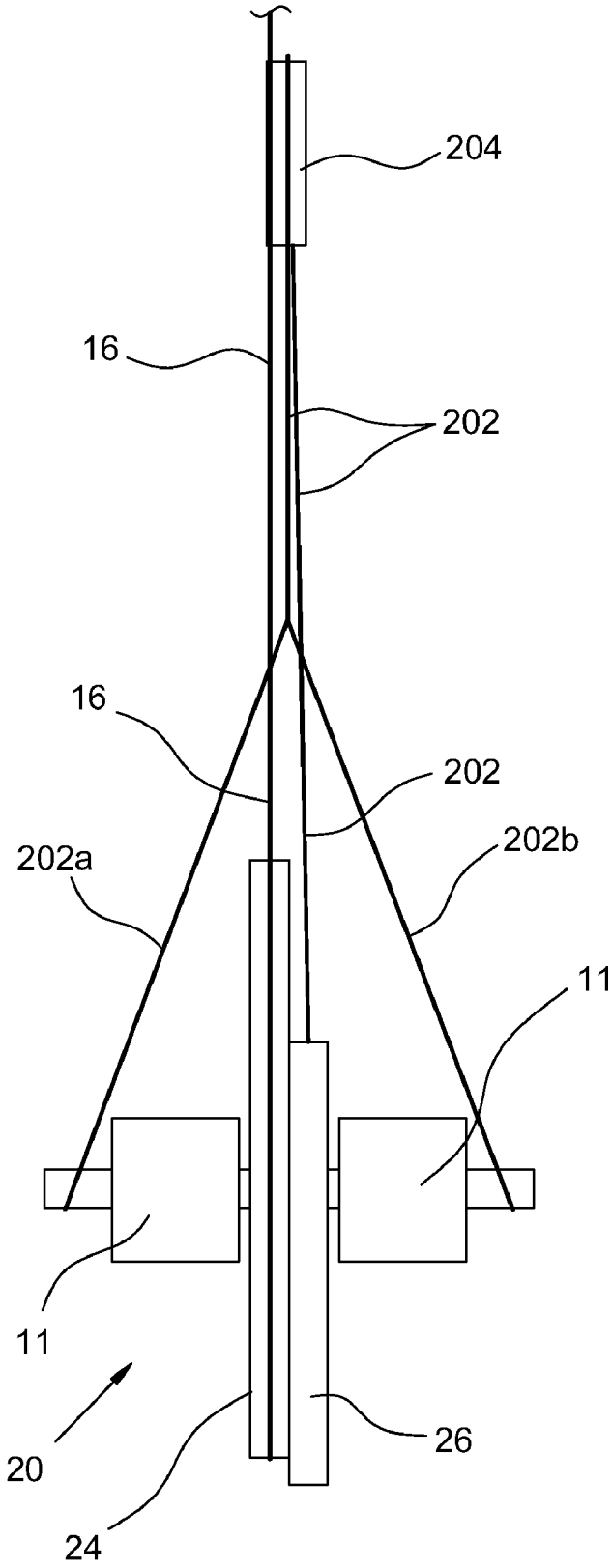
FIG. 8 is a rear view of one pulley assembly and pulley-and-cable tensioning mechanism of the exemplary dual-cam compound bow of FIGS. 3A and 3B.

The first end of the tensioning cable 202 can comprise a split cable, with each of the split ends 202*a* and 202*b* separately looping around the axle of pulley member 20 on opposite sides of limb 11 (as shown in FIG. 8). Tensioning cable 302 can be similarly secured to the axle of pulley member 302. The attachment or connection of tensioning cable by such a split cable arrangement can reduce undesirable torque exerted on the pulley member 20 or 30 and the bow limb 11 or 12 by the tension of power cable 22 or 32. Any suitable arrangement for securing the first end of the tensioning cable to the corresponding bow limb can be employed.

Figure 9:
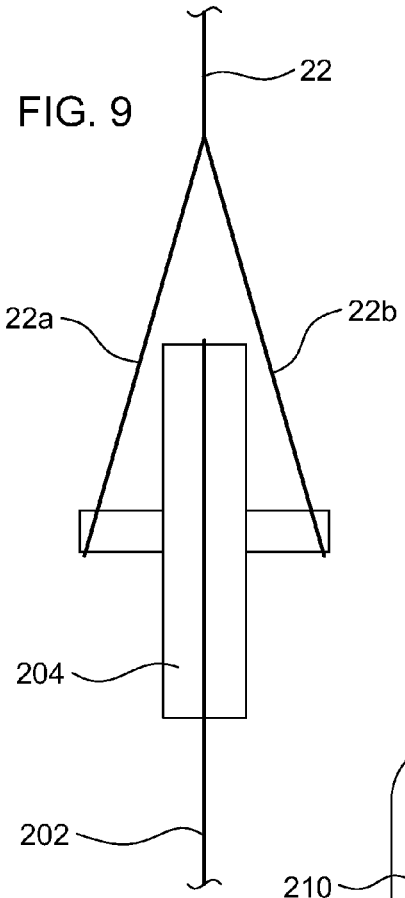
FIG. 9 is a rear view of a portion of an exemplary pulley-and-cable tensioning mechanism according to the present disclosure.
Figure 10A:
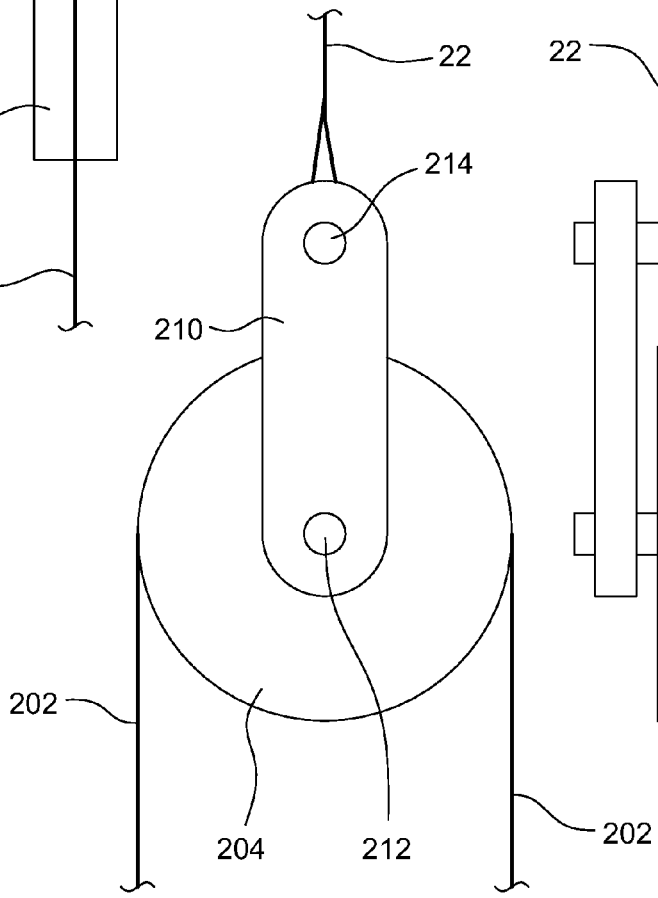
FIGS. 10A and 10B are side and rear views, respectively, of a portion of an exemplary pulley-and-cable tensioning mechanism according to the present disclosure.
Figure 10B:
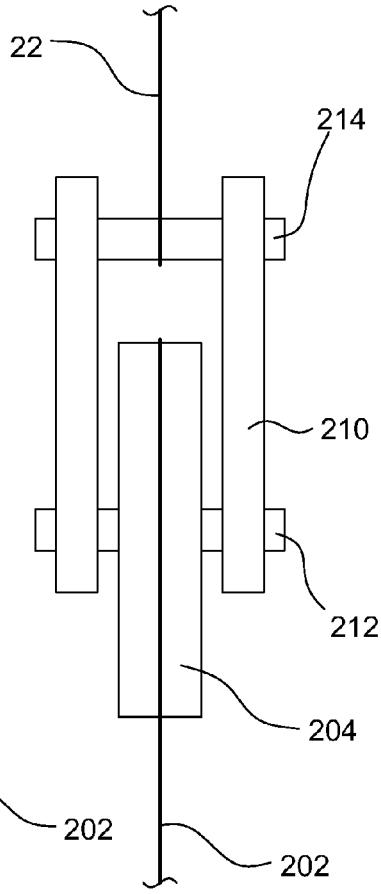

The first end of power cable 22 can be connected the tensioning pulley 204 in any suitable way. In one example, the first end of the power cable 22 can comprise two split portions 22*a* and 22*b*, and the split portions can each loop around an axle of the tensioning pulley 204 on opposite sides thereof (as in FIG. 9), thereby connecting the first end of the power cable to the first tensioning pulley. In another example, a coupler 210 can be employed having a pair of substantially parallel rods or pins 212 and 214 connected together in a substantially rigid spaced-apart arrangement (which arrangement may or may not allow rotation of the pins). The tensioning pulley 204 is mounted on pin 212 and rotatable relative to coupler 210, and the first end of the power cable 22 loops around the pin 214 (or around a wheel on pin 204; not shown), thereby connecting the first end of the power cable 22 to the tensioning pulley 204 (FIGS. 10A and 10B). Similar arrangements can be employed to connect power cable 32 to tensioning pulley 304.

Figure 5A:
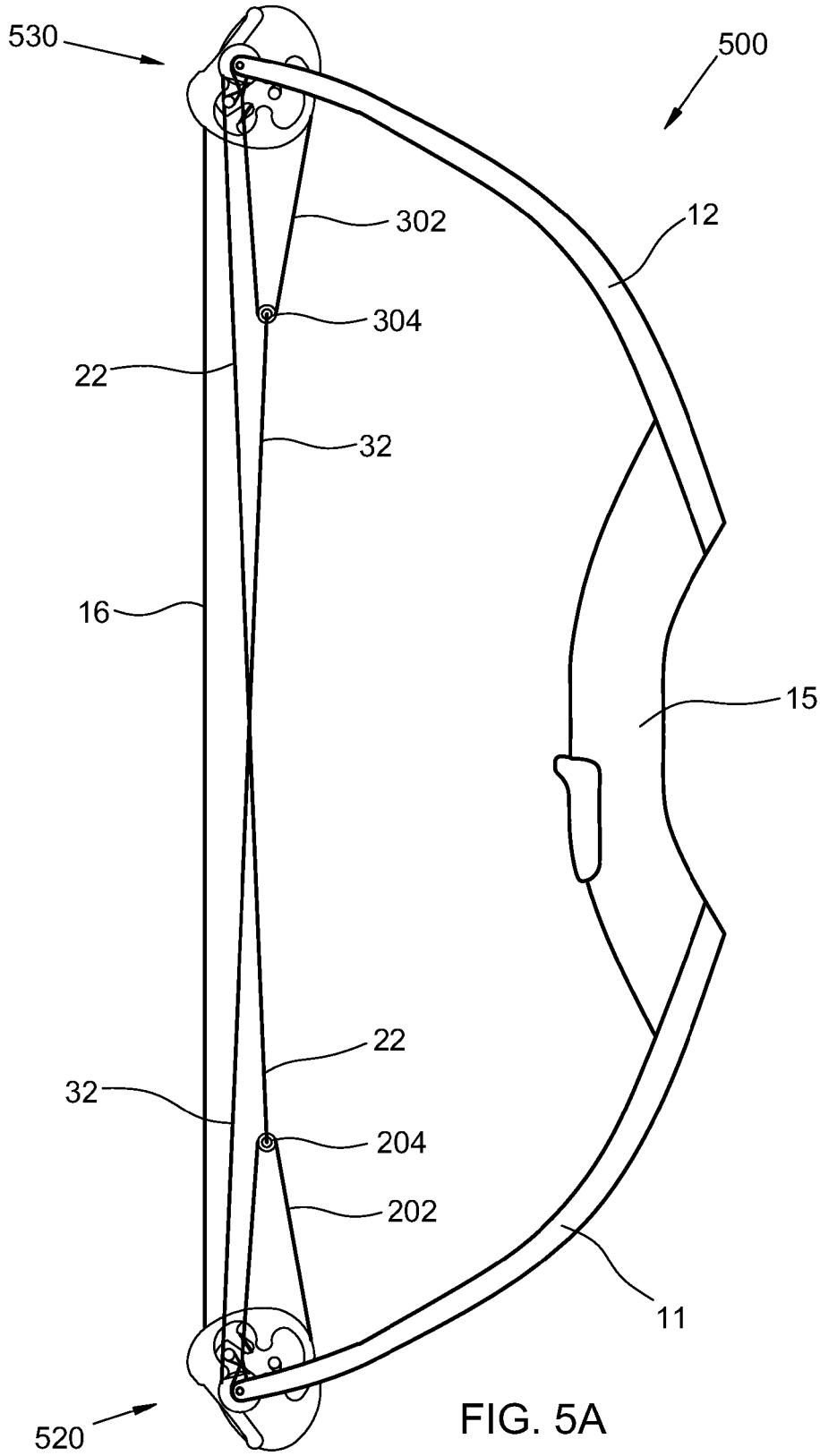
FIGS. 5A and 5B are side views at brace and at full draw, respectively, of an exemplary compound bow according to the present disclosure that employs a Binary Cam System®.
Figure 5B:
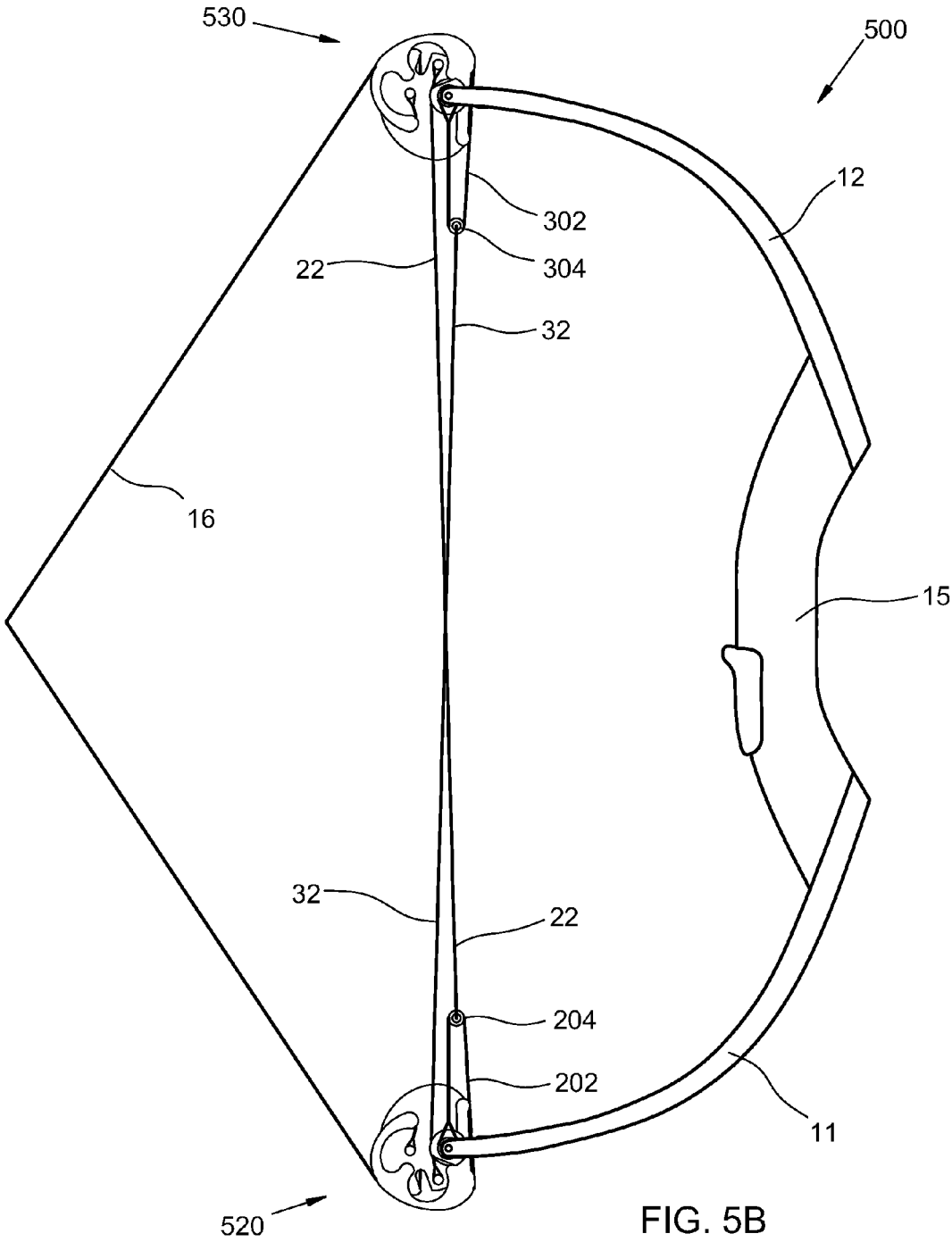

An example of a compound bow 500 is illustrated in FIGS. 5A and 5B that employs a Binary Cam System®, and includes a pulley-and-cable mechanism for tensioning the power cables. FIGS. 5A and 5B show the entire bow at brace and at full draw, respectively. The compound bow 500 includes riser 15, limbs 11 and 12, tensioning cables 202 and 302, tensioning pulleys 204 and 304, and draw cable 16 arranged in a manner generally similar to that of dual-cam bow 300. Pulley members 520 and 530 of bow 500 differ from pulley members 20 and 30 of bow 300 by each including a power cable let-out mechanism. In the example of FIGS. 5A and 5B, each power cable let-out mechanisms comprises a power cable let-out journal. Power cable 22 is connected at its second end to bow limb 12 by engagement with the power cable let-out journal of pulley member 530 and is arranged to be let out by as pulley member 530 rotates when the bow 500 is drawn. Likewise, power cable 32 is connected at its second end to bow limb 11 by engagement with the power cable let-out journal of pulley member 520 and is arranged to be let out by as pulley member 520 rotates when the bow 500 is drawn. The relative sizes, shapes, positions, or orientations of the draw cable cams, the power cable cams, and the power cable let-out mechanisms of pulley members 520 and 530 can be arranged in any suitable way to provide, in conjunction with the pulley-and-cable tensioning mechanism described above, desired draw force characteristics of the bow 500 employing the Binary Cam System®. The relative sizes, shapes, positions, and orientations shown in FIGS. 5A and 5B are exemplary only, and those relative sizes, shapes, positions, and orientations can often differ from those of a conventional bow that employs a Binary Cam System®.

Figure 6A:
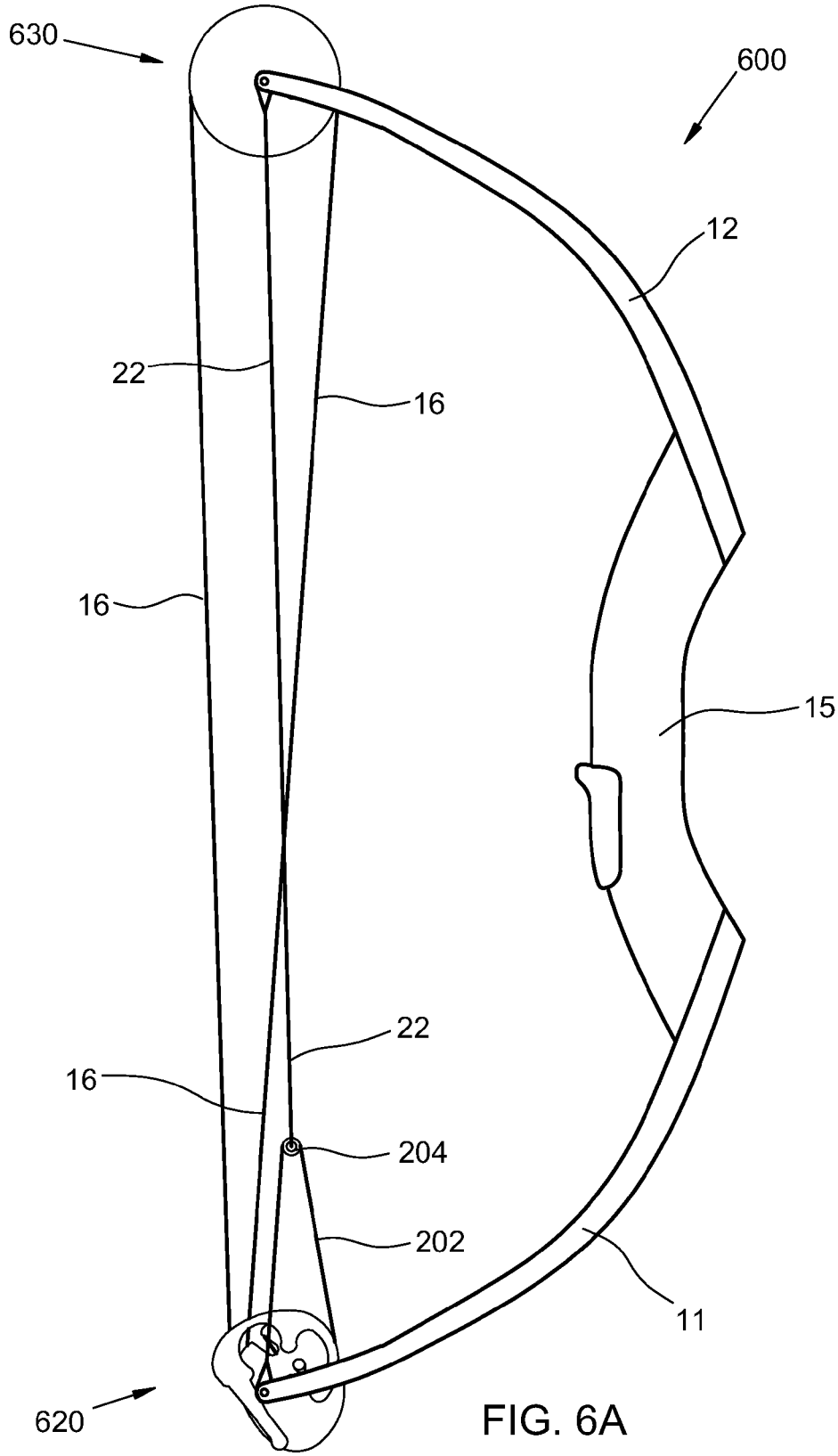
FIGS. 6A and 6B are side views at brace and at full draw, respectively, of an exemplary single-cam compound bow according to the present disclosure.
Figure 6B:
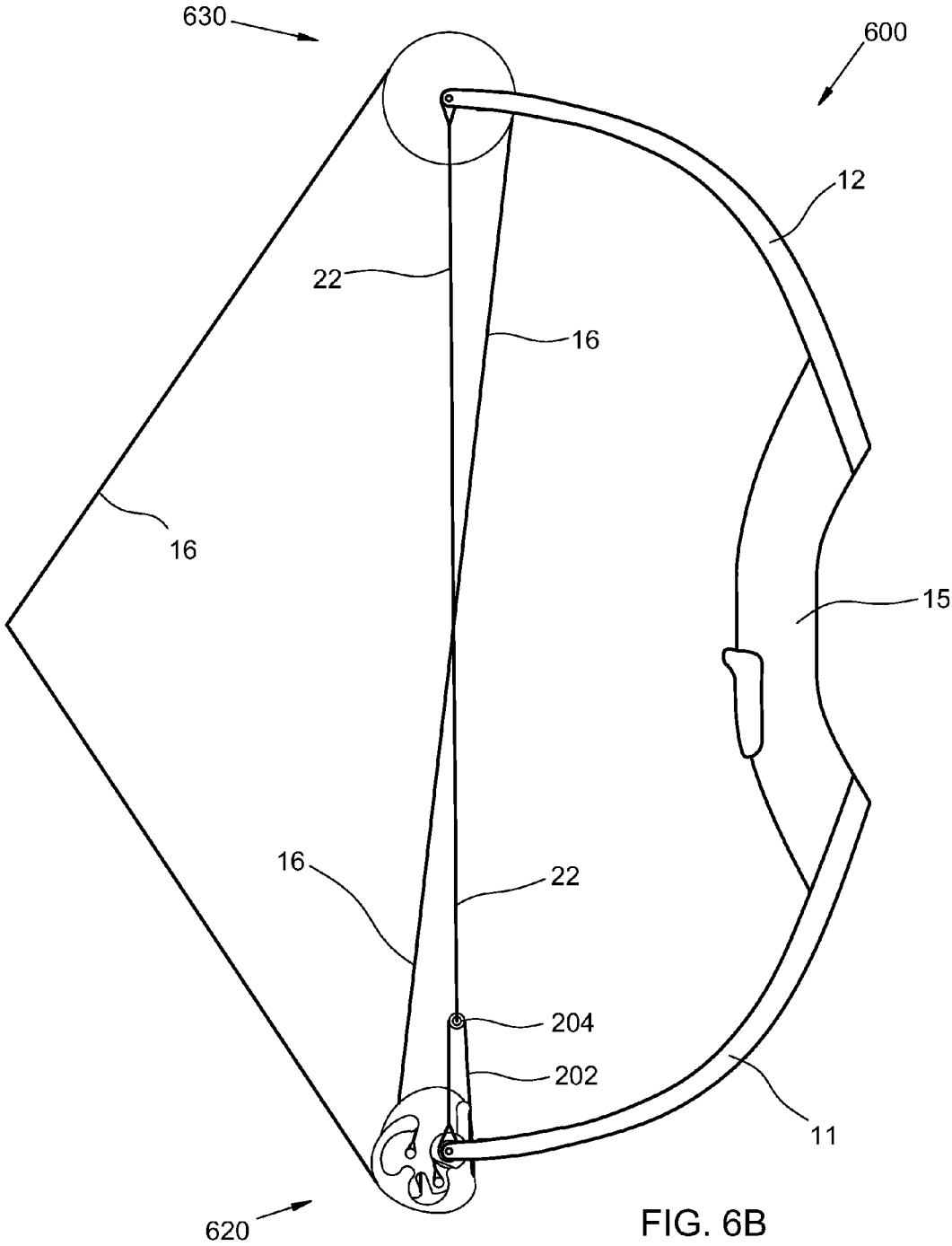

An example of a single-cam compound bow 600 is illustrated in FIGS. 6A and 6B, and includes a pulley-and-cable mechanism for tensioning the single power cable 22. FIGS. 6A and 6B show the entire bow at brace and at full draw, respectively. The single-cam compound bow 600 includes riser 15, limbs 11 and 12, tensioning cable 202, and tensioning pulley 204 arranged in a manner generally similar to that of dual-cam compound bow 300. Pulley members 620 and 630 of bow 600 differ from pulley members 20 and 30 of dual-cam bow 300. Pulley member 630 is an idler wheel, and pulley member 620 includes a let-out journal. Power cable 22 is connected at its first end to tensioning pulley as described above and at its second end to bow limb 12. Tensioning cable 202 is arranged to be taken up by the power cable cam of pulley member 620 as the bow 600 is drawn and pulley member 620 rotates, thereby applying tension to power cable 22 connected to tension pulley 204. Draw cable 16 is arranged to be let-out by the draw cable journal of pulley member 620, passes over the draw cable journal of idler wheel 630, and is arranged to be let-out by the let-out journal of pulley member 620 as the bow 600 is drawn and pulley member 620 rotates. The relative sizes, shapes, positions, or orientations of the draw cable cam, the power cable cam, and the let-out mechanism of pulley member 620 can be arranged in any suitable way to provide, in conjunction with the pulley-and-cable tensioning mechanism described above, desired draw force characteristics of the single-cam bow 600. The relative sizes, shapes, positions, and orientations shown in FIGS. 6A and 6B are exemplary only, and those relative sizes, shapes, positions, and orientations can often differ from those of a conventional single-cam bow.

Figure 7A:
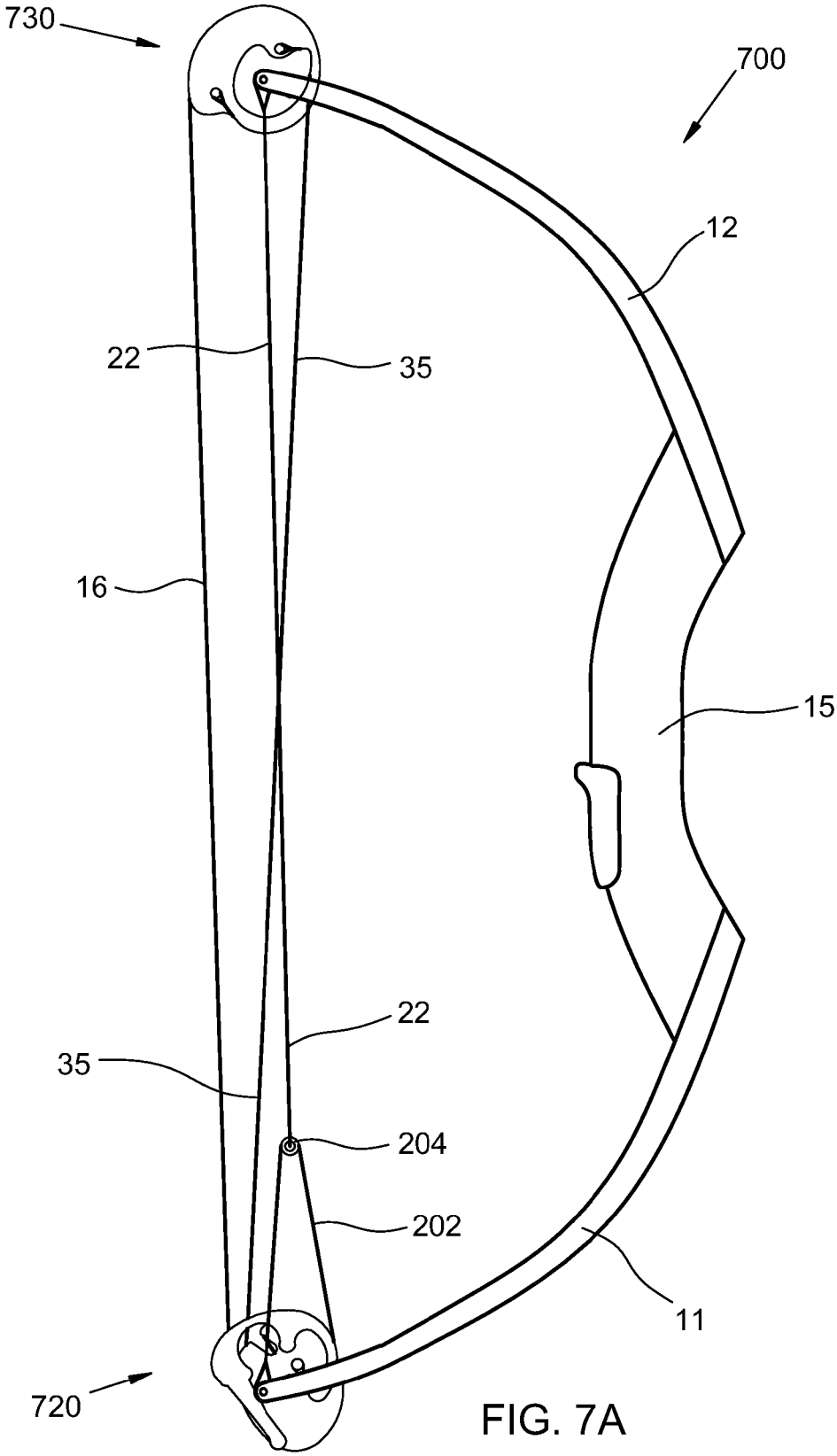
FIGS. 7A and 7B are side views at brace and at full draw, respectively, of an exemplary hybrid-cam compound bow according to the present disclosure.
Figure 7B:
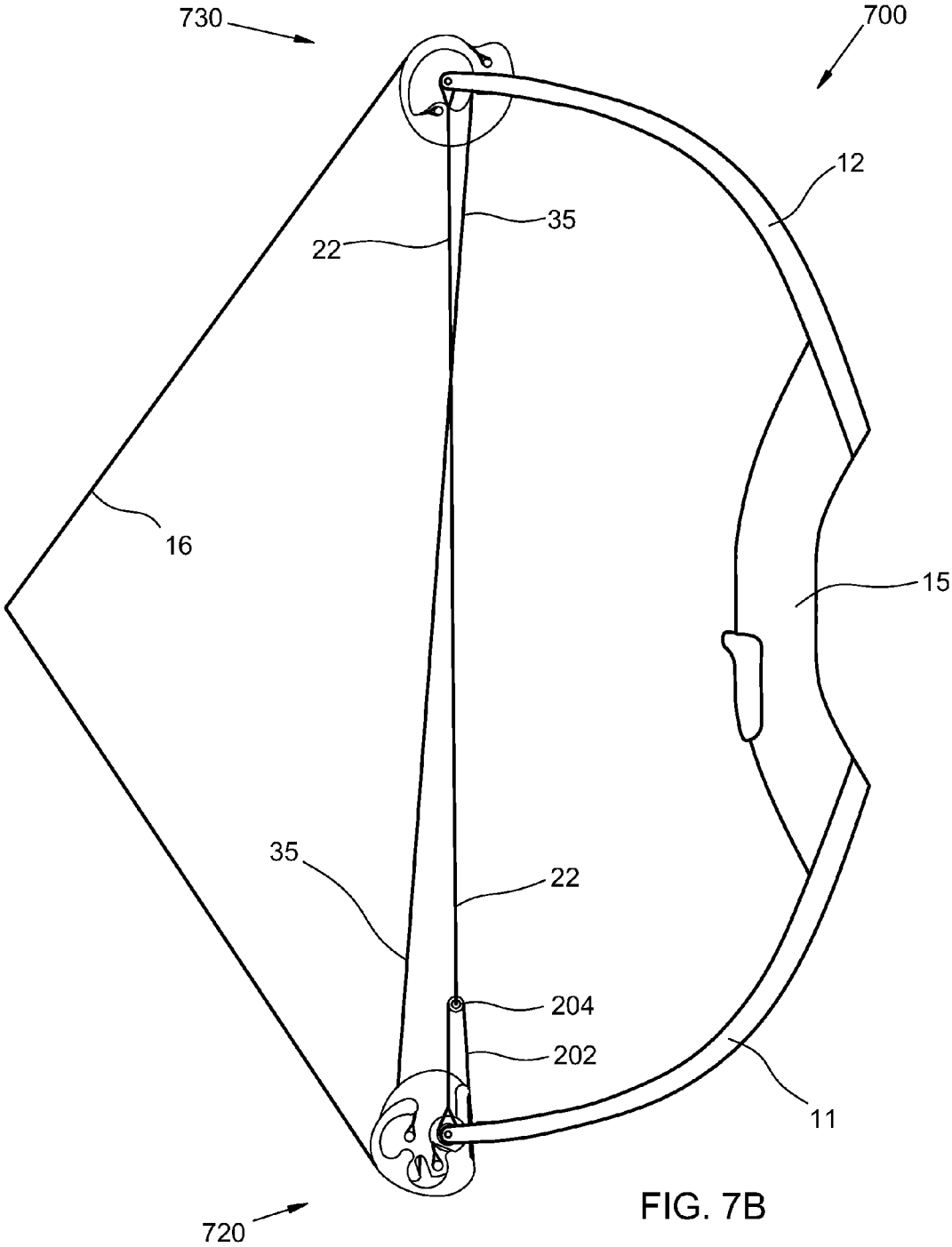

An example of a hybrid-cam compound bow 700 is illustrated in FIGS. 7A and 7B, and includes a pulley-and-cable mechanism for tensioning the single power cable 22. FIGS. 7A and 7B show the entire bow at brace and at full draw, respectively. The hybrid-cam compound bow 700 includes riser 15, limbs 11 and 12, power cable 22, tensioning cable 202, and tensioning pulley 204 arranged in a manner generally similar to that of single-cam compound bow 600. Pulley members 720 and 730 of bow 700 differ from pulley members 620 and 630 of single-cam bow 600. Pulley member 720 includes a bus cable journal, and pulley member 730 includes a draw cable journal and a bus cable journal. Power cable 22 is connected at its first end to tensioning pulley as described above and at its second end to bow limb 12. Tensioning cable 202 is arranged to be taken up by the power cable cam of pulley member 720 as the bow 700 is drawn and pulley member 720 rotates, thereby applying tension to power cable 22 connected to tension pulley 204. Draw cable 16 is arranged to be let-out by the draw cable journal of pulley member 730, and bus cable 35 is arranged to be taken up by the bus cable journal of pulley member 730, as the bow 700 is drawn and pulley member 730 rotates. Bus cable 35 is arranged to be let-out by the bus cable journal of pulley member 720 as the bow 700 is drawn and pulley member 720 rotates. The relative sizes, shapes, positions, or orientations of the draw cable cam, the power cable cam, and the bus cable journals of pulley members 720 and 730 can be arranged in any suitable way to provide, in conjunction with the pulley-and-cable tensioning mechanism described above, desired draw force characteristics of the hybrid-cam bow 700. The relative sizes, shapes, positions, and orientations shown in FIGS. 7A and 7B are exemplary only, and those relative sizes, shapes, positions, and orientations can often differ from those of a conventional hybrid-cam bow.

The various journals, cams, or mechanisms described or claimed herein for taking up or letting out a draw cable, power cable, or bus cable, can comprise any suitable arrangement for letting out or taking up a cable as the corresponding pulley member rotates, while providing a desired variation (or lack of variation) of a corresponding effective lever arm. Typically a cam (typically eccentric or non-circular) or a wheel (typically concentric and circular) is employed having a peripheral groove or journal for receiving an engaged cable. In another example, a cable can successively wrap around one or more posts on a pulley member as the pulley member rotates (to be taken up), or can successively unwrap from around one or more posts on a pulley member as the pulley member rotates (to be let out). In another example, an attachment point of a cable can be eccentrically positioned on a pulley member to provide take-up or let-out of the cable as the pulley member rotates. Any of those examples or another suitable arrangement can be employed as a journal, cam, or mechanism for taking up or letting out a cable as the pulley members rotate.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" or "one or more" were appended after each instance thereof.

What is claimed is:

1. A compound archery bow comprising:

a substantially rigid riser having first and second end portions;

a first resilient bow limb attached to the first end portion of the riser, which first bow limb has a corresponding pulley connection point;

a second resilient bow limb attached to the second end portion of the riser, which second bow limb has a corresponding pulley connection point;

a first pulley member rotatably connected to the first bow limb at the corresponding pulley connection point, which first pulley member includes a draw cable journal and a first power cam;

a second pulley member rotatably connected to the second bow limb at the corresponding pulley connection point, which second pulley member includes a draw cable journal;

a draw cable engaged with the respective draw cable journals of the first and second pulley members and arranged to rotate the first and second pulley members as the bow is drawn and the draw cable is let out from the draw cable journals;

a first tensioning cable secured at a first end thereof to the first bow limb and engaged at a second end thereof to be taken up by the first power cam as the bow is drawn and the first pulley member rotates;

a first tensioning pulley, which tensioning pulley includes a corresponding tensioning cable journal and is arranged with the first tensioning cable engaged with the corresponding tensioning cable journal; and a first power cable connected at a first end thereof to the first tensioning pulley and connected at a second end thereof to the second bow limb.

2. The bow of claim 1 wherein the second pulley member includes a second power cam, and the bow further comprises:

a second tensioning cable secured at a first end thereof to the second bow limb and engaged at a second end thereof to be taken up by the second power cam as the bow is drawn and the second pulley member rotates;

a second tensioning pulley, which tensioning pulley includes a corresponding tensioning cable journal and is arranged with the second tensioning cable engaged with the corresponding tensioning cable journal; and a second power cable connected at a first end thereof to the second tensioning pulley and connected at a second end thereof to the first bow limb.

3. The bow of claim 2 wherein:

the first pulley member further includes a corresponding power cable let-out mechanism;

the second pulley member further includes a corresponding power cable let-out mechanism;

the first power cable is connected to the second bow limb by engagement with the power cable let-out mechanism of the second pulley member so that the first power cable is let out as the bow is drawn and the second pulley member rotates; and the second power cable is connected to the first bow limb by engagement with the power cable let-out mechanism of the first pulley member so that the second power cable is let out as the bow is drawn and the first pulley member rotates.

4. The bow of claim 3 wherein each power cable let-out mechanism comprises a corresponding power cable let-out journal.

5. The bow of claim 1 wherein:

the first pulley member includes a let-out journal;

the second pulley member comprises an idler wheel with the draw cable journal; and the draw cable passes over the draw cable journal of the idler wheel and is engaged with and arranged to be let out from the let-out journal of the first pulley member as the bow is drawn and the first pulley member rotates.

6. The bow of claim 1 wherein:

the first pulley member includes a bus cable journal;

the second pulley member includes a bus cable journal;

the bow further comprises a bus cable;

the bus cable is engaged with and arranged to be let out from the bus cable journal of the first pulley member as the bow is drawn and the first pulley member rotates; and the bus cable is engaged with and arranged to be taken up by the bus cable journal of the second pulley member as the bow is drawn and the second pulley member rotates.

7. The bow of claim 1 wherein the first end of the first tensioning cable comprises two split portions, and the split portions each loop around an axle of the first pulley member on opposite sides of the first bow limb, thereby securing the first end of the tensioning cable to the first bow limb.

8. The bow of claim 1 further comprising a coupler having a pair of substantially parallel pins connected together in a substantially rigid spaced-apart arrangement, wherein the first tensioning pulley is rotatably mounted on one pin and the first end of the first power cable loops around the other pin, thereby connecting the first end of the power cable to the first tensioning pulley.

9. The bow of claim 1 wherein the first end of the first power cable comprises two split portions, and the split portions each loop around an axle of the first tensioning pulley on opposite sides thereof, thereby connecting the first end of the power cable to the first tensioning pulley.

10. A method for assembling a compound archery bow, the method comprising:

rotatably connecting a first pulley member to a first bow limb at a corresponding pulley connection point thereof, which first pulley member includes a draw cable journal and a first power cam, wherein the first bow limb is attached to a first end portion of a substantially rigid riser;

rotatably connecting a second pulley member to a second bow limb at a corresponding pulley connection point thereof, which second pulley member includes a draw cable journal, wherein the second bow limb is attached to a second end portion of the riser;

engaging a draw cable with the respective draw cable journals of the first and second pulley members and arranging the draw cable to rotate the first and second pulley members as the bow is drawn and the draw cable is let out from the draw cable journals;

securing a first tensioning cable at a first end thereof to the first bow limb and engaging the first tensioning cable at a second end thereof to be taken up by the first power cam as the bow is drawn and the first pulley member rotates;

connecting a first power cable at a first end thereof to a first tensioning pulley and connecting the first power cable at a second end thereof to the second bow limb; and engaging the first tensioning cable with a corresponding tensioning cable journal of the first tensioning pulley.

11. The method of claim 10 further comprising:

attaching the first bow limb to the first end portion of the riser; and attaching the second bow limb to the second end portion of the riser.

12. The method of claim 10 wherein the second pulley member includes a second power cam, and the method further comprises:

securing a second tensioning cable at a first end thereof to the second bow limb and engaging the second tensioning cable at a second end thereof to be taken up by the second power cam as the bow is drawn and the second pulley member rotates;

connecting a second power cable at a first end thereof to a second tensioning pulley and connecting the second power cable at a second end thereof to the first bow limb; and engaging the second tensioning cable with a corresponding tensioning cable journal of the second tensioning pulley.

13. The method of claim 12 wherein:

the first pulley member further includes a power cable let-out mechanism;

the second pulley member further includes a power cable let-out mechanism;

connecting the first power cable to the second bow limb comprises engaging the first power cable with the power cable let-out mechanism of the second pulley member so that the first power cable is let out as the bow is drawn and the second pulley member rotates; and connecting the second power cable to the first bow limb comprises engaging the second power cable with the power cable let-out mechanism of the first pulley member so that the second power cable is let out as the bow is drawn and the first pulley member rotates.

14. The method of claim 13 wherein each power cable let-out mechanism comprises a corresponding power cable let-out journal.

15. The method of claim 10 wherein:

the first pulley member includes a let-out journal;

the second pulley member comprises an idler wheel with the draw cable journal; and the method further comprises passing the draw cable over the draw cable journal of the idler wheel, engaging the draw cable with the let-out journal of the first pulley member, and arranging the draw cable to be let out from the let-out journal of the first pulley member as the bow is drawn and the first pulley member rotates.

16. The method of claim 10 wherein:

the first pulley member includes a bus cable journal;

the second pulley member includes a bus cable journal; and the method further comprises engaging a bus cable with the bus cable journal of the first pulley member, arranging the bus cable to be let out from the bus cable journal of the first pulley member as the bow is drawn and the first pulley member rotates, engaging the bus cable with the bus cable journal of the second pulley member, and arranging the bus cable to be taken up by the bus cable journal of the second pulley member as the bow is drawn and the second pulley member rotates.

17. The method of claim 10 wherein securing the first end of the tensioning cable to the first bow limb comprises looping around an axle of the first pulley member on opposite sides of the first bow limb two split portions that comprise the first end of the first tensioning cable.

18. The method of claim 10 wherein connecting the first end of the power cable to the first tensioning pulley comprises (i) rotatably mounting the first tensioning pulley on one of a pair of substantially parallel pins connected together in a substantially rigid spaced-apart arrangement by a coupler, and (ii) looping the first end of the first power cable around another pin of the pair.

19. The method of claim 10 wherein connecting the first end of the power cable to the first tensioning pulley comprises looping around an axle of the first tensioning pulley on opposite sides thereof two split portions that comprise the first end of the first power cable.

* * * * *